US006404341B1

(12) United States Patent
Reid

(10) Patent No.: US 6,404,341 B1
(45) Date of Patent: Jun. 11, 2002

(54) SECURITY TAG AND METHOD OF MAKING THE SAME

(75) Inventor: Jeffrey Reid, Longford Mills (CA)

(73) Assignee: 1175634 Ontario Limited, Toronto (CA)

( * ) Notice: Subject to any disclaimer, the term of this patent is extended or adjusted under 35 U.S.C. 154(b) by 0 days.

(21) Appl. No.: 09/543,918

(22) Filed: Apr. 6, 2000

Related U.S. Application Data

(60) Provisional application No. 60/127,893, filed on Apr. 6, 1999.

(51) Int. Cl.[7] ..... G08B 13/14
(52) U.S. Cl. ..... 340/572.8; 156/60
(58) Field of Search ..... 340/572.8, 572.1; 342/51; 156/60

(56) References Cited

U.S. PATENT DOCUMENTS

| | | | | |
|---|---|---|---|---|
| 4,151,405 A | | 4/1979 | Peterson | 235/382 |
| 4,581,524 A | * | 4/1986 | Hoekman et al. | 340/572.1 X |
| 4,626,311 A | | 12/1986 | Taylor | 156/308 |
| 4,717,438 A | | 1/1988 | Benge et al. | 156/152 |
| 5,406,263 A | * | 4/1995 | Tuttle | 340/572.8 X |
| 5,495,250 A | * | 2/1996 | Ghaem et al. | 342/51 |
| 5,583,489 A | | 12/1996 | Loemker et al. | 340/572 |
| 5,614,278 A | * | 3/1997 | Chamberlain et al. | 428/41.4 |
| 5,859,587 A | * | 1/1999 | Alicot et al. | 340/572.8 |
| 5,982,284 A | * | 11/1999 | Baldwin et al. | 340/572.8 |

FOREIGN PATENT DOCUMENTS

| | | |
|---|---|---|
| DE | 4323883 A1 | 1/1995 |
| EP | 0446910 A1 | 9/1991 |
| EP | 0858061 A2 | 8/1998 |
| GB | 2310977 | 9/1997 |
| WO | WO9914717 | 3/1999 |

* cited by examiner

*Primary Examiner*—Thomas Mullen
(74) *Attorney, Agent, or Firm*—Hodgson Russ LLP

(57) ABSTRACT

A security tag has two encapsulating strips, with an anti-theft strip between the encapsulating strips. The encapsulating strips are attached to each other by an adhesive. In a method for making such a security tag, a first encapsulating strip is provided, an anti-theft strip is placed on the first encapsulating strip, an adhesive is applied to the first encapsulating strip, and then a second encapsulating strip is provided and attached to the first encapsulating strip using the adhesive.

11 Claims, 6 Drawing Sheets

SECURITY TAG AND METHOD OF MAKING THE SAME

CROSS-REFERENCE TO RELATED APPLICATION

This application claims priority to an earlier filed U.S. provisional patent application having Ser. No. 60/127,893, which was filed on Apr. 6, 1999.

BACKGROUND OF THE INVENTION

1. Field of the Invention

The present invention relates to an improved security tag and a method of making such a security tag. The security tag of the present invention can be used with clothing or other articles in order to prevent theft, for example from a retail store.

2. Description of the Prior Art

It is known in the prior art to use a pair of metallic strips attached to an article to prevent theft of the article. In such anti-theft systems, a magnetic field is established at an exit of a retail store. When the metallic strips enter the magnetic field, the magnetic field is disturbed and the presence of the magnetic strips is thereby detected. Upon detection, an alarm is caused to sound.

In lieu of a magnetic based system, radio frequency systems are also commonly known. Such systems use a radio frequency detection and emission device ("RFDED") attached to an article. A first radio frequency is emitted near an exit of the retail store. When the first radio frequency is detected by the RFDED, the RFDED emits a second radio frequency, which is detected by an alarm system. RFDED's are commonly referred to as a "radio frequency resistor" and may be included with a device commonly referred to as a "radio frequency identification strip."

The magnetic strips, radio frequency resistor and radio frequency identification strip described above are examples of anti-theft devices commonly in use. After reading this disclosure, it will be apparent to those skilled in the art that the present invention is not limited to a magnetic strip, radio frequency resistor or a radio frequency identification strip. These three devices are merely examples of the types of anti-theft devices that may be used with the present invention. Since the commonly used anti-theft devices are usually contained on a strip, such devices are herein referred to as "anti-theft strips."

In some of the prior art methods and devices, the anti-theft strip is covered by a fabric-like material, and then the edges of the material are sealed by application of heat or ultrasonic vibrations to encapsulate the anti-theft strip within the material. Such a method and device is disclosed in U.S. Pat. No. 5,583,489. A problem with such prior art devices is that the fabric-like material which encapsulates the anti-theft strip is easily separated to remove the anti-theft strip and thereby defeat the security function of the anti-theft strip.

SUMMARY OF THE INVENTION

An object of the present invention is to provide a security tag which holds the anti-theft strip in a secure manner.

Another object of the present invention is to provide a method of making the anti-theft strip according to the present invention.

Accordingly, the present invention includes an improved security tag and a method of making such a security tag. The security tag of the present invention includes two encapsulating strips, with an anti-theft strip between the encapsulating strips, and an adhesive for attaching the encapsulating strips to each other.

In the method of the present invention, a first encapsulating strip is provided, an anti-theft strip is placed on the first encapsulating strip, an adhesive is applied to at least one of the encapsulating strips, and then a second encapsulating strip is provided and pressed to the first encapsulating strip.

DESCRIPTION OF THE PREFERRED EMBODIMENT

Figure 1:
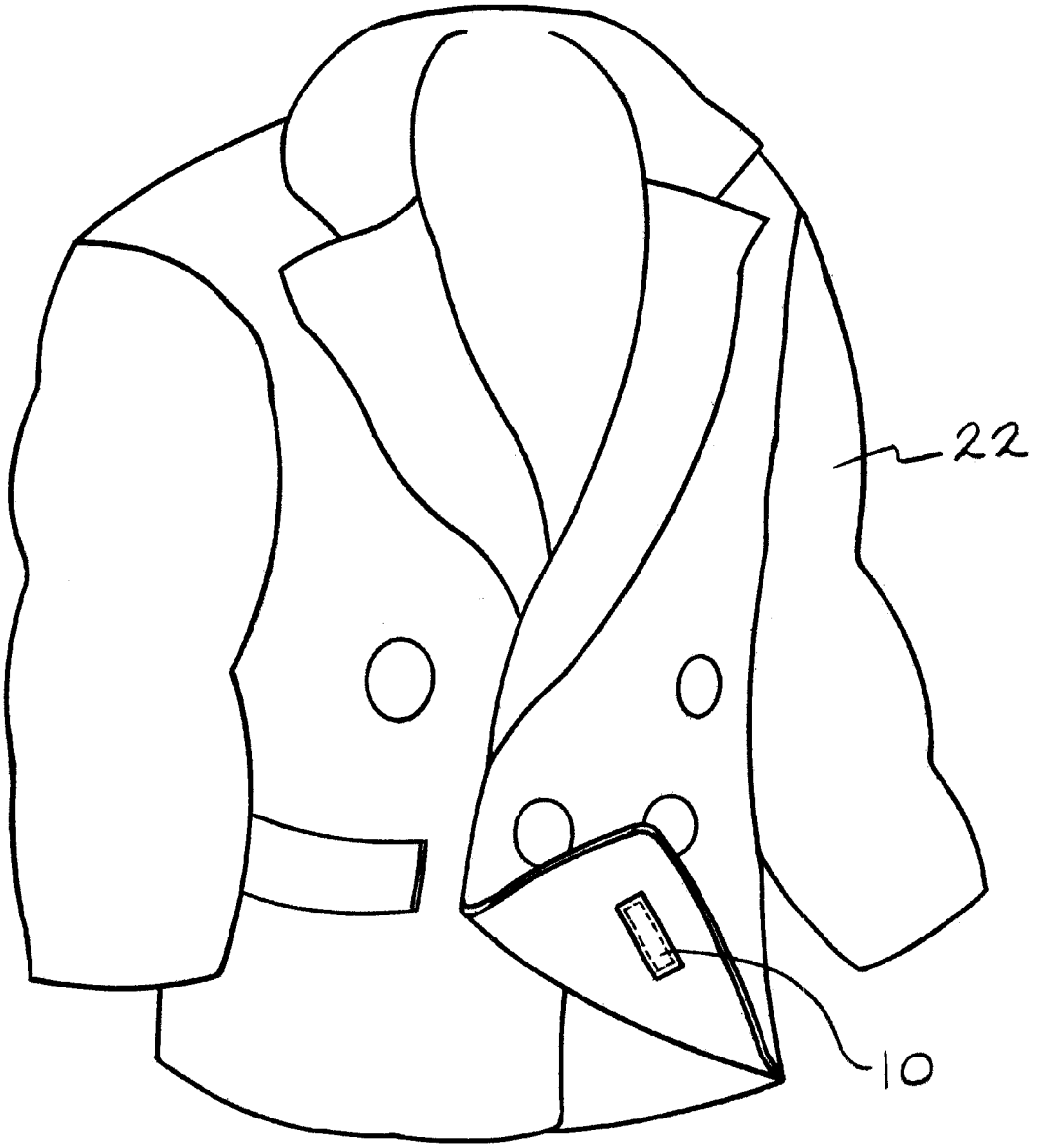
FIG. 1 shows an embodiment of the security tag of the present invention attached to an article of clothing.
Figure 2:
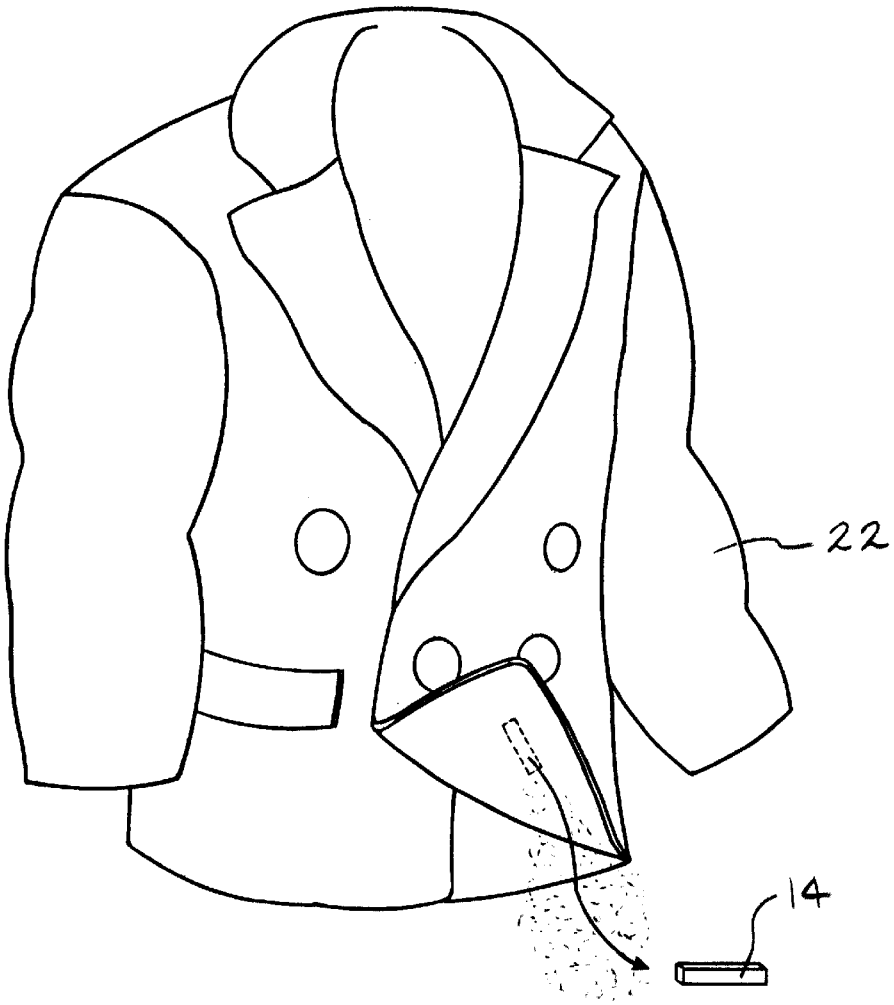
FIG. 2 illustrates an embodiment of the present invention in which upon cleaning the article of clothing, the anti-theft strip will leave the article of clothing.
Figure 3:
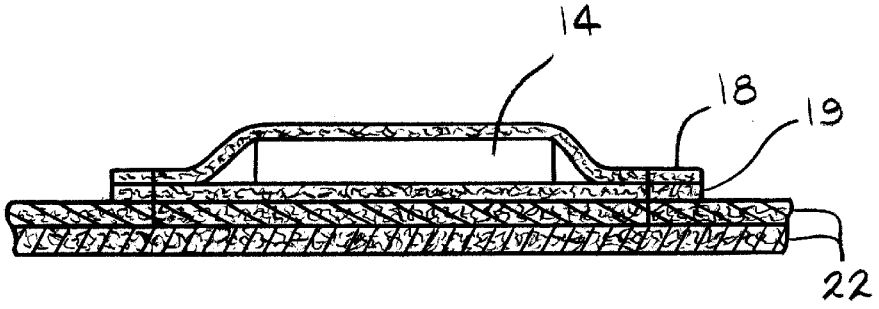
FIG. 3 is a cross-sectional view of the security tag according to the present invention attached to an article.

The present invention is an improved security tag 10 and a method of making such a security tag 10. As shown in FIGS. 1–3, the security tag 10 has a means for providing security (herein referred to as an "anti-theft strip") 14, such as a pair of metallic strips, held between two encapsulating strips 18,19. As discussed above, other types of anti-theft strips 14 are known in the art, including radio frequency resistors and radio frequency identification strips, and the present invention is not limited to any particular anti-theft strip 14.

One or both encapsulating strips 18,19 may be a flexible fabric. The flexible fabric may be woven, but a preferred flexible fabric is comprised of a blown fiber, and preferably includes polyester fibers. Such a blown fiber fabric is preferably comprised of 60% polyester, 39% cellulose and 1% polyvinyl alcohol. This preferred blown fiber fabric will allow a security tag 10 attached to an article 22 to be removed by tearing the encapsulating strips 18,19.

The encapsulating strips 18,19 are attached to each other by an adhesive 24. A preferred adhesive 24 is marketed under the trade name 3M 100 Fastbond Adhesive manufactured by the 3M Company located in Minnetonka, Minn. When the preferred adhesive 24 is used with the preferred blown fiber fabric, the adhesive 24 bonds the polyester fibers of the encapsulating strips 18,19 together to securely hold the anti-theft strip 14 between the encapsulating strips 18,19.

The encapsulating strips 18,19 may be larger than the anti-theft strip 14 in order to provide a location for attaching the security tag 10 to the article 22, such as an article of clothing. It is anticipated that a security tag 10 will be attached, for example by sewing, to the article 22, but a security tag 10 may also be placed inside the article 22 without attaching the security tag 10 to the article 22.

In an embodiment of the present invention, the adhesive 24 is water based so that the adhesive 24 will deteriorate after repeated cleaning of the article 22. One such adhesive 24 is the 3M 100 Fastbond Adhesive referenced above. When such an adhesive 24 is applied to only one of the encapsulating strips 18,19, the encapsulating strips 18, 19 will separate after one or two cleanings and release the anti-theft strip 14, as illustrated in FIG. 2. However, if the adhesive 24 is applied to both encapsulating strips 18, 19, many more cleanings are required to cause the encapsulating strips 18, 19 to separate.

Figure 4:
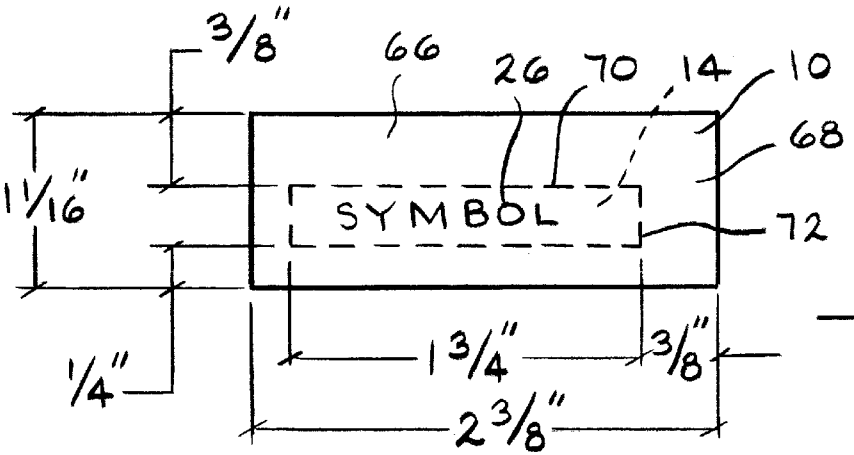
FIG. 4 is a top view of an embodiment of the security tag according to the present invention.

FIG. 4 shows that a symbol 26, such as a trade name, can be printed on one or both of the encapsulating strips 18,19. Furthermore, one or both of the encapsulating strips 18,19 may be colored or sized as desired.

Figure 5:
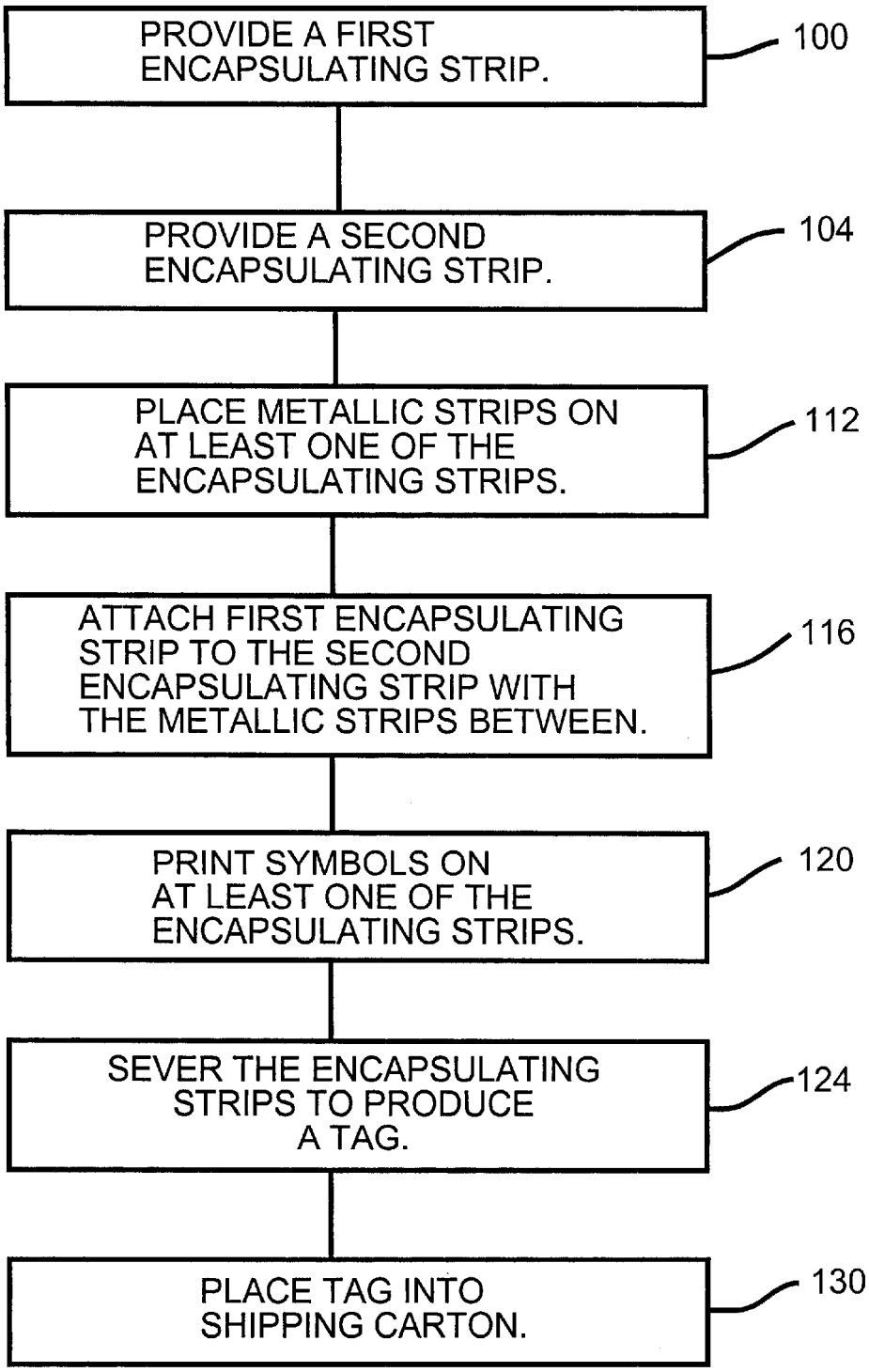
FIG. 5 is a flow chart showing steps of a method according to the present invention.

As shown in FIG. 5, a method of making the security tag 10 according to the present invention may begin by a first providing step 100 wherein the first encapsulating strip 18 is provided, and a second-providing step 104 wherein the second encapsulating strip 19 is provided. The method also includes a placing step 112 during which an anti-theft strip 14 is placed on the first encapsulating strip 18, and includes an attaching step 116 during which the second encapsulating strip 19 is attached to the first encapsulating strip 18, so as to hold the anti-theft strip 14 between the first and second encapsulating strips 18,19. In an embodiment of the method according to the present invention, the attaching step 116 includes applying an adhesive 24 to at least one of the encapsulating strips 18,19. The adhesive 24 may be applied by an air atomizing low pressure spray gun, such as model number Mach 1A Automatic manufactured by ITW Binks, located in Chicago, Ill.

The steps of the method described above need not be done in the order described. For example, the adhesive 24 applied in the attaching step 116 may be applied prior to the placing step 112 wherein the anti-theft strip 14 is placed on at least one of the encapsulating strips 18,19, or alternatively, may be applied after the placing step 112.

In a preferred method according to the present invention a symbol 26 is printed (step 120) on at least one of the encapsulating strips 18,19. Finally, the encapsulating strips 18,19 are severed (step 124) to produce a security tag 10, and placed in a shipping carton (step 130).

Figure 6:
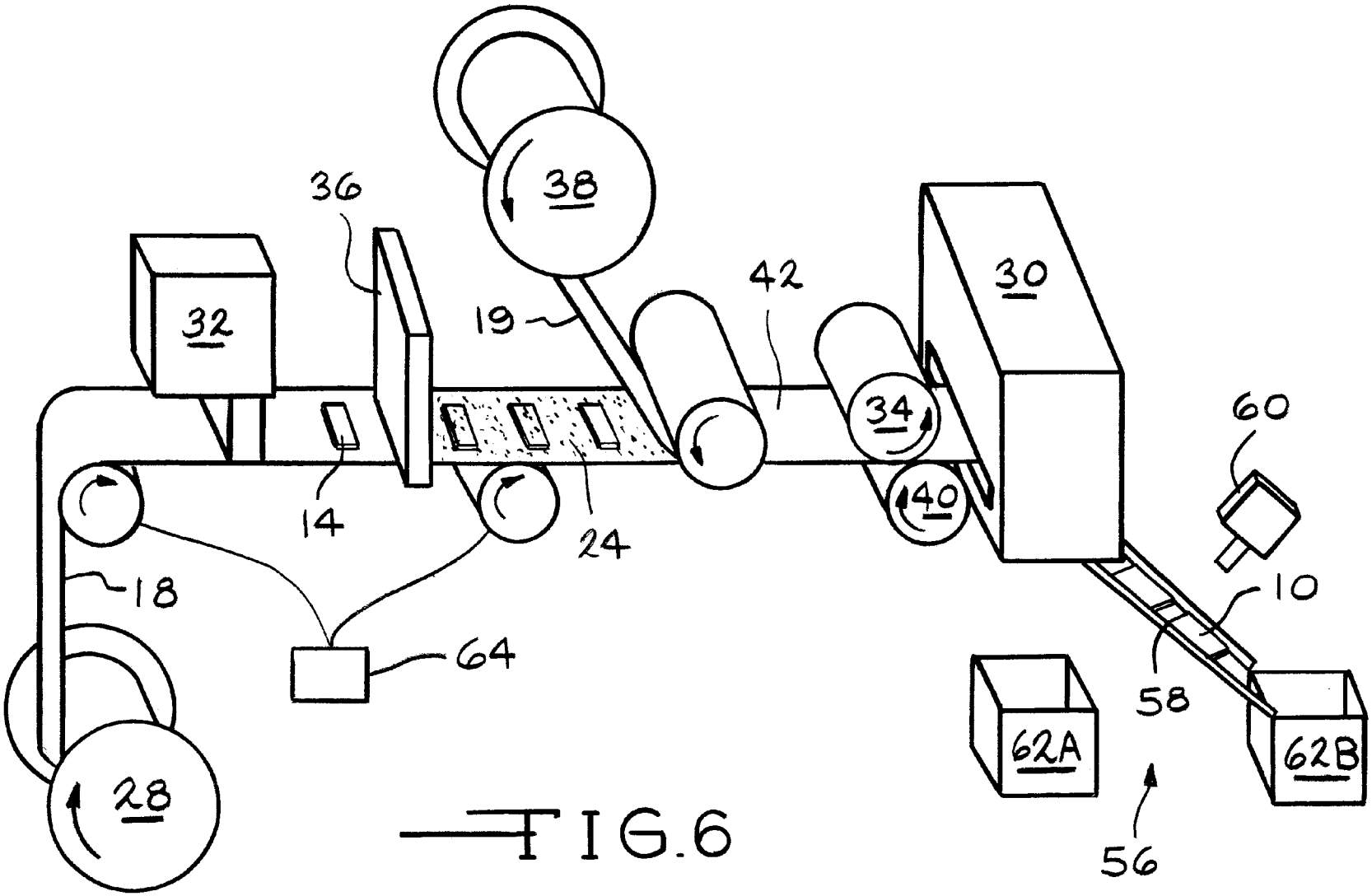
FIG. 6 is a perspective view of an apparatus for making the security tag according to the present invention.

The method of the present invention can be practiced in a continuous process by an apparatus depicted in FIG. 6. In an example of such a continuous process, a ribbon of the first encapsulating strip 18 is fed from a first spool 28 to a cutter 30. As the first encapsulating strip 18 is fed to the cutter 30, anti-theft strips 14 are placed on the first encapsulating strip 18 by a strip dispenser 32 at a rate of about between 150 to 300 anti-theft strips 14 per minute, preferably at a location on the first encapsulating strip 18 prior to the printing machine 34. The strip dispenser 32 may be a wipe-on label application system, model number ALS-230R manufactured by Avery Dennison located in Hamburg, Germany.

As shown in FIG. 6, after placing the anti-theft strip 14 on the first encapsulating strip 18, the adhesive 24 is sprayed on a surface of the first encapsulating strip 18 by a sprayer 36, and then a ribbon of the second encapsulating strip 19 preferably having a width about equal to the first encapsulating strip 18 is fed from a second spool 38 and positioned over the first encapsulating strip 18, with adhesive 24 applied thereon, and over the anti-theft strip 14. As suggested above, the second encapsulating strip 19 may be sprayed with adhesive 24, for example, in the same manner as that described above with regard to the first encapsulating strip 18. Then in an attaching step 116 the second encapsulating strip 19 is attached to the first encapsulating strip 18 and to the anti-theft strip 14, preferably by pressing the first and second encapsulating strips 18,19 together to cause the adhesive 24 to adhere to both encapsulating strips 18,19. The force required to press the encapsulating strips 18,19 may be provided by the printing machine 34 and an opposing roller 40.

Figure 8:
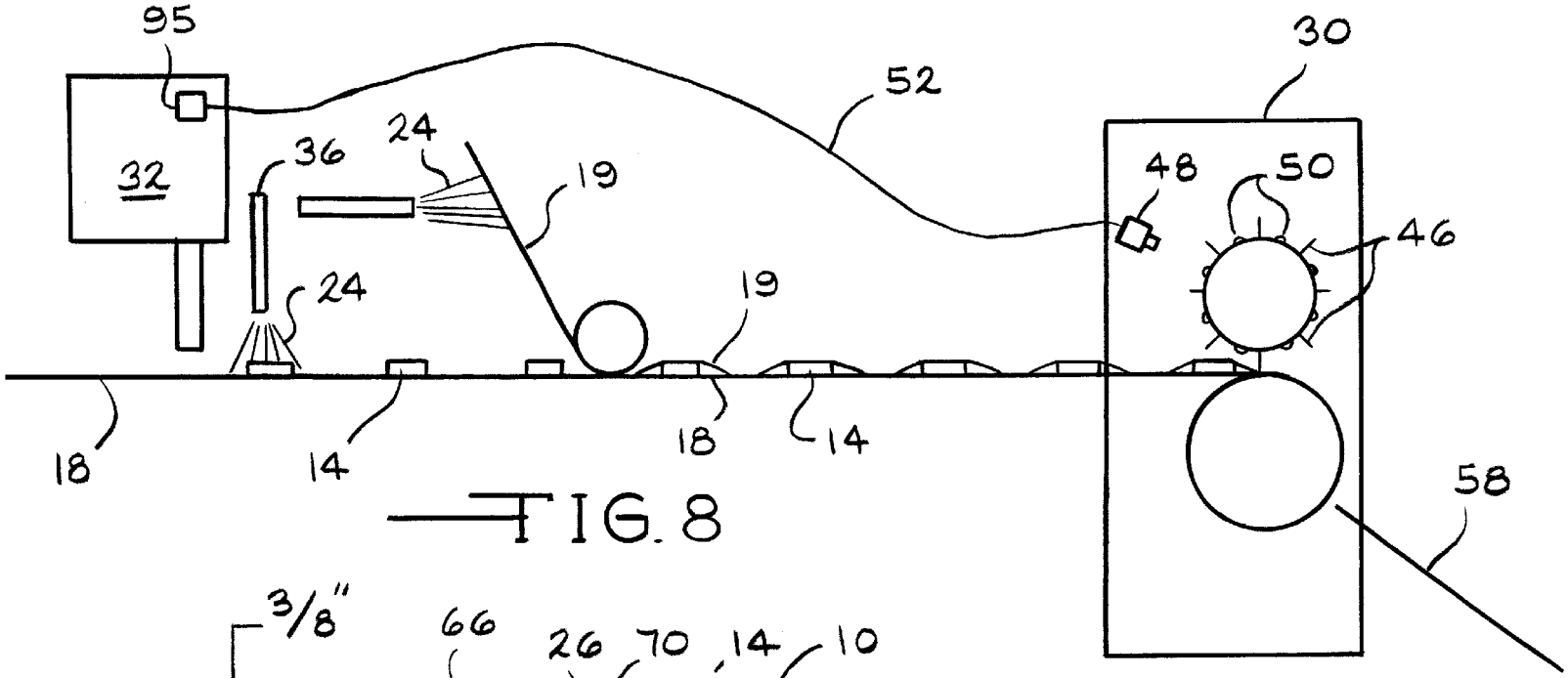
FIG. 8 is a schematic of part of an apparatus for making the security tag according to the present invention.

A surface 42 of either the first encapsulating strip 18, or the second encapsulating strip 19, or both, may then be subjected to the printing step 120 wherein a symbol 26 is printed by the printing machine 34 on one of the encapsulating strips 18,19. After the printing step 120, if any, the first and second encapsulating strips 18,19 are subjected to the severing step 124 wherein the encapsulating strips 18,19 are severed, for example by a cutter 30, to produce individual security tags 10. As shown in FIG. 8, the cutter 30 may include a cylinder 44 with cutting blades 46 arranged thereon, which is commonly known in the industry as a rotary cutter, and can be obtained from Calmec Precision Limited, located in Mississauga, Ontario.

FIG. 8 shows an optical sensor 48 inside the cutter 30. The optical sensor 48 detects marks on the cylinder 44 and sends a signal to the strip dispenser 32 via communication line 52. Upon receiving the signal from the optical sensor 48, the strip dispenser 32 is directed to dispense an anti-theft strip 14. An adjustable delay circuit 95 may be included so that the strip dispenser 32 is directed to dispense an anti-theft strip 14 at a time after the signal from the optical sensor 48 is received. In this manner, the anti-theft strip 14 can be properly positioned within the encapsulating strips 18,19, for example as shown in FIG. 4 and described above.

The security tags 10 are then sent to a packaging area 56, which may include a diverter chute 58 and a unit counter 60, for placing a predetermined number of the security tags 10 in a container 62B. The diverter chute 58 may be movable so as to permit placement of the security tags 10 in either container 62A or container 62B without moving the containers 62A, 62B. The unit counter 60 may include an optical sensing device such as model number E3SAD61, manufactured by Omron located in Japan. Alternatively, the strip dispenser 32 may include a counter, such as model number GEM20000 manufactured by Red Lion located in York, Pa.

It is contemplated that such a continuous process would need anti-static equipment 64 to protect the integrity of the anti-theft strip 14. Such anti-static equipment 64 can be obtained from Calmec Precision Limited, located in Mississauga, Ontario.

Figure 7:
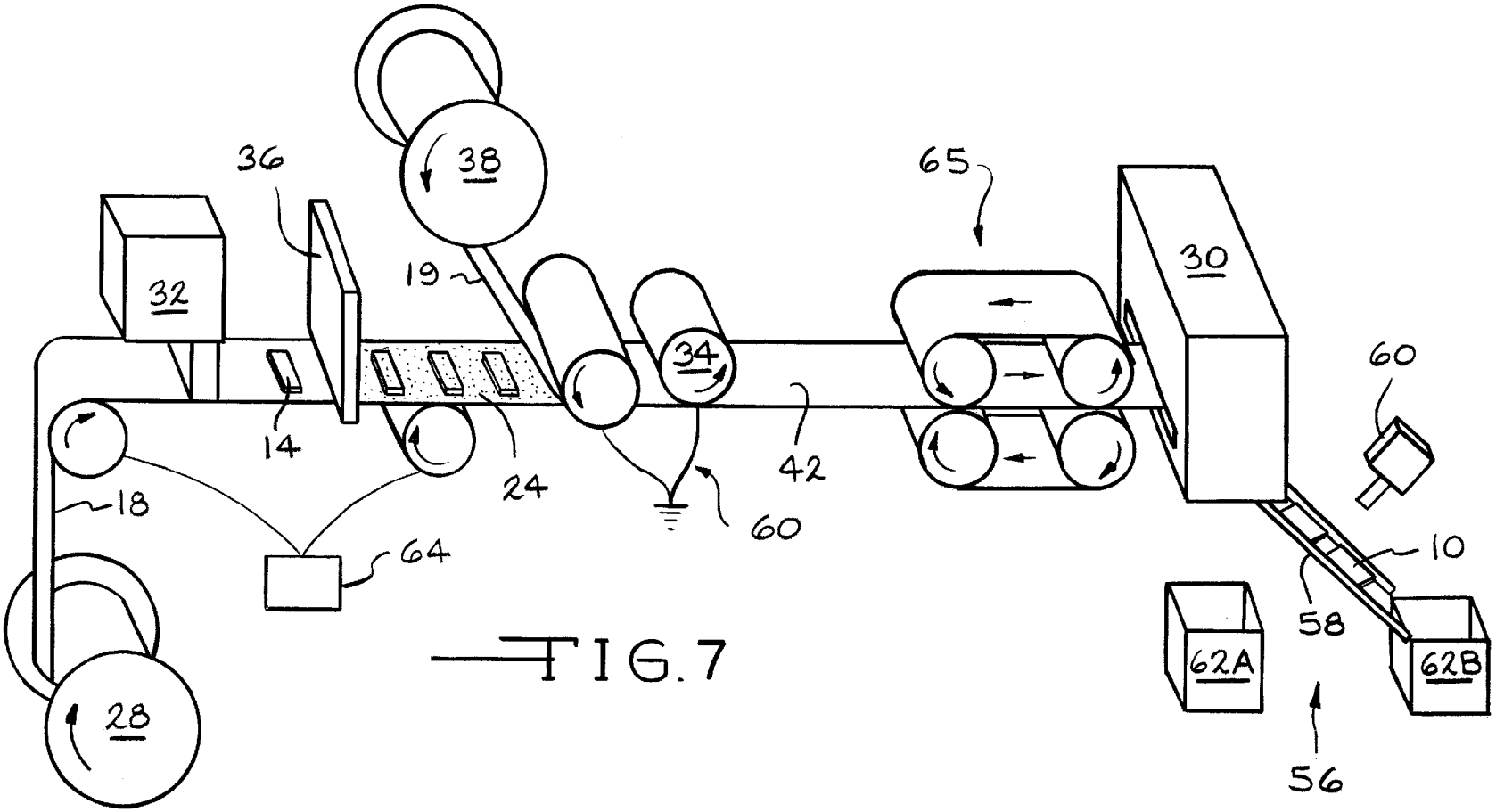
FIG. 7 is a perspective view of another apparatus similar to that shown in FIG. 6 with a caterpuller added.

The apparatus of FIG. 6 can be modified as shown in FIG. 7 by adding a caterpuller 65. The caterpuller 65 is well known in the art, and can be obtained from Calmec Precision Limited, located in Mississauga, Ontario.

An example of the security tag 10 produced by the continuous process described above is shown in FIG. 4. It is preferred that the anti-theft strip 14 be placed off center so as to leave wider areas 66,68 of the encapsulating strips 18,19 adjacent to two sides 70,72 of the anti-theft strip 14. The wider areas 66,68 permit easy attachment of the security device 10 to an article 22, for example by sewing the security device in the wider areas 66,68 to the article 22. It should be noted that the dimensions of the security tag 10 shown in FIG. 4 are merely preferred dimensions that make the security tag 10 easy to apply with commonly used manufacturing equipment.

It is apparent that the present invention accomplishes the intended objects described above. The security tag of the present invention holds the anti-theft strip 14 in a secure manner, and the present invention provides a method of making the security tag.

Although preferred embodiments of the present invention have been described and illustrated herein, the present invention is not limited to such preferred embodiments. Since various changes could be made without departing from the spirit and scope of the invention, it is intended that the foregoing description shall be interpreted as illustrative, and not interpreted in a limiting sense. Furthermore, it is intended that the present invention shall be limited only by the following claims.

What is claimed is:

1. A method of making a security tag comprising:

providing a first encapsulating strip;

placing an anti-theft strip on the first encapsulating strip;

applying an adhesive to the first encapsulating strip;

providing a second encapsulating strip;

pressing the second encapsulating strip to the first encapsulating strip so as to attach the first encapsulating strip to the second encapsulating strip to hold the anti-theft strip between the first and second encapsulating strips, wherein the first encapsulating strip is fabric and wherein the fabric further comprises blown fiber, and wherein the blown fiber is polyester.

2. A method of making a security tag comprising:

providing a first encapsulating strip;

placing an anti-theft strip on the first encapsulating strip;

providing a second encapsulating strip;

applying an adhesive to the second encapsulating strip;

pressing the second encapsulating strip to the first encapsulating strip so as to attach the first encapsulating strip to the second encapsulating strip to hold the anti-theft strip between the first and second encapsulating strips, wherein the second encapsulating strip is fabric and wherein the fabric further comprises blown fiber, and wherein the blown fiber is polyester.

3. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the first encapsulating strip is fabric, and wherein the fabric is comprised of blown fiber.

4. The security tag of claim 3 wherein the anti-theft strip is one of the following selected from the group consisting of: a metallic strip; a radio frequency resistor; and a radio frequency identification strip.

5. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the first encapsulating strip is fabric, and wherein the fabric is comprised of blown fiber, and wherein the blown fiber is polyester.

6. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the second encapsulating strip is fabric and wherein the fabric is comprised of blown fiber.

7. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the second encapsulating strip is fabric and wherein the fabric is comprised of blown fiber, and wherein the blown fiber is polyester.

8. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the first encapsulating strip is fabric, and wherein the fabric is comprised of blown fiber, and wherein the blown fiber includes polyester fibers.

9. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the first encapsulating strip is fabric, and wherein the fabric is comprised of blown fiber, and wherein the blown fiber comprises polyester and cellulose.

10. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the second encapsulating strip is fabric and wherein the fabric is comprised of blown fiber, and wherein the blown fiber includes polyester fibers.

11. A security tag comprising:

a first encapsulating strip;

an anti-theft strip on the first encapsulating strip;

a second encapsulating strip on the anti-theft strip and the first encapsulating strip;

an adhesive between the first and second encapsulating strips for bonding the first encapsulating strip to the second encapsulating strip, wherein the second encapsulating strip is fabric and wherein the fabric is comprised of blown fiber, and wherein the blown fiber comprises polyester and cellulose.

* * * * *